United States Patent [19]

Babin et al.

[11] Patent Number: 4,935,599

[45] Date of Patent: Jun. 19, 1990

[54] AIR-CONDITIONING DEVICE, ESPECIALLY FOR RAILROAD CARS

[75] Inventors: James Babin, Sartrouville; Pierre Rougier, Livry Gargan; Jean-Luc Sadkiewicz, Argenteuil; Bernard Vella, Yerres, all of France

[73] Assignee: Faiveley S.A., Saint-Ouen, France

[21] Appl. No.: 372,634

[22] Filed: Jun. 13, 1989

[30] Foreign Application Priority Data

Jun. 14, 1988 [FR] France ..... 88 07910

[51] Int. Cl.[5] ..... H05B 1/00; H05B 3/00

[52] U.S. Cl. ..... 219/202; 98/14; 219/366; 237/12.6

[58] Field of Search ..... 98/13, 14, 38.9, 2.05, 98/38.3, 38.1; 237/12.6, 46; 219/202, 366–370

[56] References Cited

U.S. PATENT DOCUMENTS

| | | | |
|---|---|---|---|
| 2,811,091 | 10/1957 | Kice | 98/38.1 X |
| 3,263,743 | 8/1966 | Baungarten | 98/38.9 X |
| 3,265,859 | 8/1966 | Castello et al. | 98/38.9 X |
| 3,330,200 | 7/1967 | Gillick et al. | 98/13 |
| 3,528,614 | 9/1970 | Honmann | 98/38.3 X |

FOREIGN PATENT DOCUMENTS

| | | |
|---|---|---|
| 0155256 | 9/1985 | European Pat. Off. . |
| 0239548 | 9/1987 | European Pat. Off. . |
| 1455078 | 4/1969 | Fed. Rep. of Germany . |
| 2145744 | 7/1973 | Fed. Rep. of Germany . |
| 2461606 | 2/1981 | France . |

*Primary Examiner*—William E. Topolcai

*Attorney, Agent, or Firm*—Young & Thompson

[57] ABSTRACT

The air-conditioning device, in particular for a railroad car (2), includes a fan (1) for blowing cold or heated air into a conduit (4), the upper portion of which opens into a space (7) delimited by two parallel walls (8, 9) which are adjacent to the lateral face (5) of the railroad car (2). The space (7) is provided with apertures (10) located substantially at the level of the car windows (11). The conduit (4) is provided on its lateral face with an air discharge vent (13) which extends over the full length of the car. The wall (9) of the space (7) which is adjacent to the interior of the car is provided with a slit (6) located near the conduit (4), the air contained in the car (2) being sucked through the slit (6) into the space 97).

7 Claims, 2 Drawing Sheets

AIR-CONDITIONING DEVICE, ESPECIALLY FOR RAILROAD CARS

BACKGROUND OF THE INVENTION

1. Field of the Invention

The present invention relates to an air-conditioning device for vehicles, especially for railroad cars.

2. Description of the Prior Art

French Pat. No. 2,461,606 has described an air-conditioning installation for railroad cars, comprising a fan for blowing cold or heated air within a conduit which extends along the bottom portion of the internal lateral face of the car. This conduit opens into ducts for distributing the cold or heated air towards the top of the internal lateral face of the car and towards the bottom of this latter.

These distribution ducts are provided in an intermediate zone with an opening through which the air contained in the car is sucked into the above-mentioned distribution ducts.

Thus the installation comprises along each side wall of the car a succession of vertical ducts for upward and downward distribution of air.

Moreover, the conduit is provided opposite to each duct with an air delivery opening fitted with means for regulating the air flow rate. The air discharged from these openings is directed substantially parallel to the floor of the railroad car and practically at the level of the user's feet.

This air-conditioning installation is subject to a certain number of drawbacks.

In the first place, this installation is ill-suited to modern railroad cars which are not of the compartment type or in other words which do not have transverse partition-walls.

Thus in cars of this type, air is discharged into the interior of the car through openings which are separated from each other and fail to ensure uniform and homogeneous mixing of air.

This irregularity of mixing of air thus produces discontinuities of air flow rate and temperature which are detrimental to the comfort of passengers.

By reason of their motionless state, passengers are in fact very sensitive even to very slight differences in temperature as well as to local draughts at specific points.

Moreover, the present Applicant has observed that passengers were particularly disturbed by local draughts blown directly at the level of their feet.

The aim of the present invention is to overcome the disadvantages of the known installation referred-to in the foregoing by proposing an air-conditioning device which is better suited to modern railroad cars without compartments while making it possible to obtain uniform and homogeneous mixing of air, thereby ensuring that passengers have the benefit of optimum comfort.

SUMMARY OF THE INVENTION

The air-conditioning device contemplated by the invention comprises at least one fan for blowing cold or heated air into a conduit which extends along the bottom portion of the internal lateral face of the vehicle, said conduit being intended to open into means for distributing cold or heated air towards the top of said internal lateral face and towards the bottom of said face, said distribution means being such as to include in an intermediate zone an opening through which the air contained in the vehicle is sucked into said distribution means.

The device in accordance with the invention is distinguished by the fact that the upper portion of the conduit aforesaid opens into a space delimited by two parallel walls adjacent to the lateral face of the vehicle and extending without any interruption of continuity over the entire length of the vehicle, the top portion of said space being intended to open into the interior of the vehicle through apertures located substantially at the level of the vehicle windows, that the conduit is provided on its lateral face which is adjacent to the interior of the vehicle with an air delivery vent which extends substantially over the entire length of the vehicle and that the wall of the space aforesaid which is adjacent to the interior of the vehicle is provided near the conduit with a slit which extends over substantially the entire length of the vehicle and through which the air contained in the vehicle is sucked into the space aforesaid.

The fact that the air distribution space extends over substantially the entire length of the vehicle permits perfect adaptation of the device in accordance with the invention to the continuity of the lateral face of the vehicle, in particular of a railroad car without compartments. The vehicle may thus be equipped, for example, with seats which are spaced with respect to each other at a distance which is wholly independent of the presence of the air-conditioning device.

Moreover, by virtue of the fact that the space aforesaid is perfectly continuous, the air delivered by the device is diffused within the vehicle at a uniform temperature and flow rate.

Furthermore, in view of the fact that the air discharged from the bottom of the device passes out of the conduit through a substantially continuous slit, the flow rate and temperature of the air are perfectly uniform over the entire length of the vehicle and passengers are not liable to experience unpleasant local draughts at the level of their feet.

In accordance with an advantageous embodiment of the invention, the side wall of the conduit is provided at the top with openings through which air is discharged into a compartment which opens downwards through a slit and said slit extends in a continuous manner over substantially the entire length of the vehicle.

Since the above-mentioned slit directs cold air downwards or in other words towards the floor, this cold air does not directly encounter passengers' feet, with the result that passengers are not hindered by the air which is discharged from the bottom portion of the device.

The device in accordance with the invention makes it possible to carry out mixing of air in the shape of continuous superposed rolls. One of these rolls is formed by air discharged from the bottom of the device through a continuous slit and returned upwards from this latter through the slit which extends at the lower end of the space formed by the two parallel walls. The other roll is formed by air discharged from the top of the device and returned downwards into this latter through the aforementioned slit. The continuity of these rolls permits efficient mixing of air throughout the internal volume of the vehicle.

DETAILED DESCRIPTION OF THE INVENTION

Figure 1:
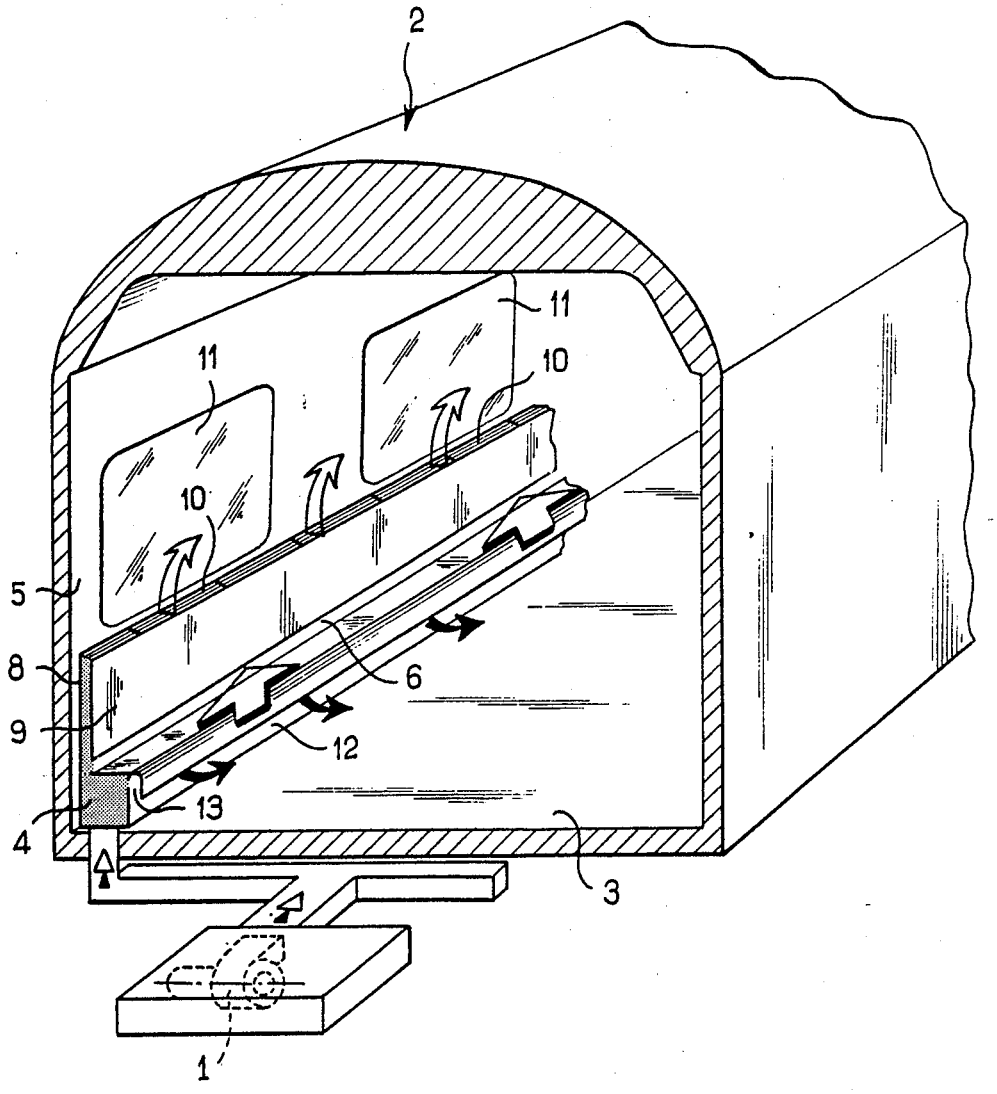
FIG. 1 is a schematic view in perspective showing an air-conditioning device in accordance with the invention inside a railroad car.
Figure 2:
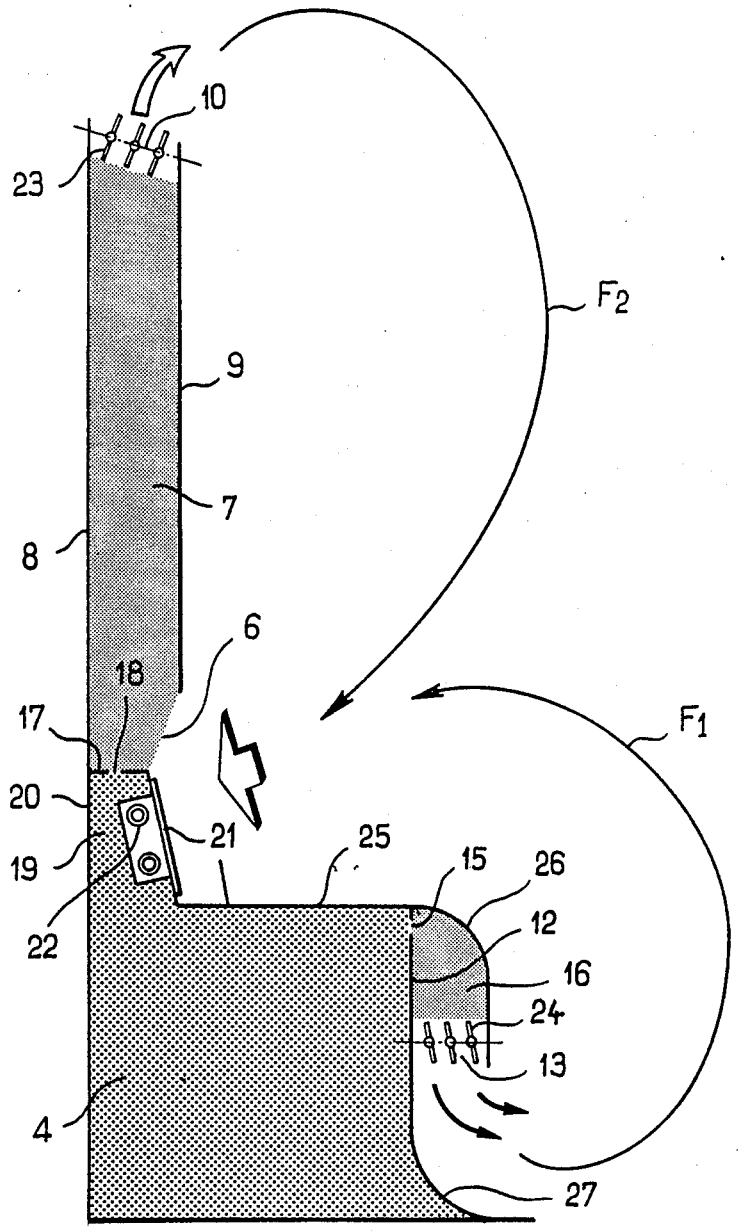
FIG. 2 is a transverse sectional view of the air-conditioning device in accordance with the invention.

Reference being made to FIGS. 1 and 2 of the accompanying drawings, the air-conditioning device in accordance with the invention includes a fan 1 placed beneath the floor 3 of the railroad car 2, the function of said fan being to blow cold or heated air into a conduit 4 which extends along the bottom portion of the internal lateral face 5 of the car 2. Said conduit 4 opens into means for distributing cold or heated air towards the top of the internal lateral face 5 and towards the bottom of this latter.

Said distribution means are provided in an intermediate zone with an opening 6 through which the air contained in the car 2 is sucked into said distribution means.

In accordance with the invention, the upper portion of the conduit 4 opens into a space 7 delimited by two parallel walls 8, 9 which are adjacent to the lateral face 5 of the car 2 and extend along the entire length of the car without any interruption of continuity.

The top portion of the space 7 is provided with apertures 10 of substantial length for delivering air into the interior of the car, said apertures being located substantially at the level of the bottom edge of the car windows 11.

As shown in FIG. 2, the conduit 4 is provided on its lateral face 12 adjacent to the interior of the car with an air vent 13 which extends over the entire length of the car.

Moreover, that wall 9 of the space 7 which is adjacent to the interior of the car is provided next to the conduit 4 with a slit 6 which extends over the entire length of the car and through which the air contained in said car is sucked into the aforementioned space 7.

It is also apparent from FIG. 2 that the upper portion of the side wall 12 of the conduit 4 has air discharge openings 15 of small cross-section constituting ejectors which open into a compartment 16. Said compartment has a downward opening or slit 13 which extends continuously over the full length of the car 2.

Furthermore, the conduit 4 is provided on its top face 17 adjacent to the space 7 with openings 18 of small cross-section constituting ejectors which discharge into the space 7.

As indicated in FIG. 2, the upper portion of the conduit 4 has a zone 19 delimited by upwardly convergent walls 20, 21, the summit 17 of this zone being provided with the openings 18 through which air is discharged into the space 7.

Moreover, the slit 6 through which the air contained in the car 2 is sucked into the aforementioned space 17 is located substantially opposite to the openings 18 through which air is discharged into said space 7.

It can also be seen in FIG. 2 that an auxiliary electric heating resistor 22 is placed slightly upstream of the openings 18 which discharge into the space 7. Said resistor 22 is fixed against the wall 21 of the convergent zone 19.

In addition, the apertures 10 of the space 7 which have their openings substantially at the level of the windows 11 and the downward-opening slit 13 of the conduit 4 are provided with orientable strips 23, 24 for adjusting the direction of air delivery.

The compartment 16 located downstream of the air delivery openings 15 and upstream of the slit 13 has an external wall which is joined to the top wall 25 of the conduit 4 by means of a rounded portion 26 which guides the air towards the slit 13.

Furthermore, the bottom portion of the side wall 12 of the conduit 4 has a rounded zone 27 which deflects the air laterally towards the interior of the car.

The operation of the air-conditioning device in accordance with the invention will now be described.

At a flow rate which is adjustable according to requirements, hot or cold air is blown by the fan 1 into the conduit 4 which extends along the bottom portion of the lateral face 5 of the car. From said conduit 4, air is blown upwards by the ejectors 18 and downwards to the floor of the car by the ejectors 15.

As a result of the partial vacuum produced by blowing air through the ejectors 18, the air contained in the car is sucked into the space 7 through the slit 6. Thus the air discharged through the apertures 10 is constituted by a mixture of air which comes from the conduit 4 and from the interior of the car.

By virtue of the fact that the air blown by the ejectors 15 is deflected downwards by the wall 22, passengers' feet are not directly exposed to an unpleasant local draught.

As a result of the suction produced by the slit 6, the air blown downwards forms a lower mixing "roll" (see arrow $F_1$ in FIG. 2) whilst the air which is blown upwards forms an upper mixing roll (see arrow $F_2$ in FIG. 2). These two mixing rolls make it possible to obtain uniform mixing which affects substantially the entire internal volume of the car and thus offers a higher degree of comfort for passengers.

Moreover, the two continuous walls 8 and 9 which delimit the space 7 provide the internal lateral face 5 of the car with complementary heat and sound insulation.

The electric resistor 22 which is placed within the zone 19 makes it possible if necessary to heat the air which is blown into the space 7.

As will be readily apparent, the invention is not limited to the example of construction which has just been described and any number of modifications may accordingly be contemplated without thereby departing from the scope of the invention.

Thus the bottom conduit 4 of the device can be extended towards the interior of the vehicle so that its top face constitutes the floor of the vehicle on which seats can be fixed directly.

Moreover, the ejection openings 15 formed in the vertical wall 12 of the conduit 4 could be formed in a wall perpendicular to this latter which extends within the space 16.

Furthermore, the ejection openings 18 formed in the wall 17 located at the bottom of the vertical compartment 7 could be located closer together at the level of the windows 11 than at other locations in order to permit a higher rate of flow of hot or cold air at the level of the windows and thus to compensate for heat losses which are higher at this level than elsewhere.

What is claimed is:

1. An air-conditioning device for vehicles (2) and in particular for railroad cars, comprising at least one fan (1) for blowing cold or heated air into a conduit (4) which extends along the bottom portion of the internal lateral face (5) of the vehicle (2), said conduit (4) being intended to open into means for distributing cold or heated air towards the top of said internal lateral face (5) and towards the bottom of said face, said distribution means being such as to include in an intermediate zone an opening (6) through which the air contained in the vehicle is sucked into said distribution means, wherein the upper portion of the conduit (4) opens into a space (7) delimited by two parallel walls (8, 9) adjacent to the lateral face (5) of the vehicle and extending without any interruption of continuity over the entire length of the vehicle, the top portion of said space (7) being intended to open into the interior of the vehicle through apertures (10) located substantially at the level of the vehicle windows (11), wherein the conduit (4) is provided on its lateral face (12) which is adjacent to the interior of the vehicle with an air delivery vent (13) which extends substantially over the entire length of the vehicle and wherein that wall (9) of the space (7) which si adjacent to the interior of the vehicle is provided near the conduit (4) with a slit (6) which extends over the entire length of the vehicle and through which the air contained in the vehicle is sucked into the space (7) aforesaid, a side wall (12) of the conduit (4) having at the top openings (15) through which air is discharged into a compartment (16) which opens downwards through a slit (13), said slit extending in a continuous manner over substantially the entire length of the vehicle. substantially the entire length of the vehicle.

2. A device according to claim 1, wherein the conduit (4) is provided on a surface (17) adjacent to the space (7) delimited by two parallel walls (8, 9) with openings (18) which discharge into said space.

3. A device according to claim 2, wherein the upper portion of the conduit (4) has a zone (19) delimited by upwardly convergent walls (20, 21), the summit (17) of said zone being provided with the openings (18) which discharge into said space (7).

4. A device according to claim 2, wherein the slit (6) through which the air contained in the vehicle is sucked into the space (7) aforesaid is located substantially opposite to the openings (18) through which air is discharged into said space.

5. A device according to claim 2, wherein an auxiliary electric heating resistor (22) is placed slightly upstream of the openings (18) which discharge into said space (7).

6. A device according to claim 5, wherein said electric resistor (22) is located within the zone (19) which is delimited by convergent walls (20, 21).

7. A device according to claim 1, wherein the apertures (10) of the space (7) which open substantially at the level of the windows and/or the slit (13) of the conduit (4) which opens downwards are provided with orientable strips (23, 24) for adjusting the direction of air delivery.

* * * * *